United States Patent [19]

Karrip et al.

[11] 4,183,581

[45] Jan. 15, 1980

[54] POSTURE IRON WITH SAFETY STOP

[75] Inventors: Alexander A. Karrip, Grand Rapids; Joseph M. Wisniewski, Wyoming; Charles C. Pergler, Kentwood, all of Mich.

[73] Assignee: Steelcase Inc., Grand Rapids, Mich.

[21] Appl. No.: 883,415

[22] Filed: Mar. 6, 1978

[51] Int. Cl.[2] ..... A47C 3/00

[52] U.S. Cl. ..... 297/306

[58] Field of Search ..... 297/300–306

[56] References Cited

U.S. PATENT DOCUMENTS

| | | | |
|---|---|---|---|
| 3,612,604 | 10/1971 | Meinhardt | 297/303 |
| 3,758,157 | 9/1973 | Fries | 297/306 X |
| 4,065,176 | 12/1977 | Fontana | 297/304 |

*Primary Examiner*—James C. Mitchell

[57] ABSTRACT

The specification discloses a chair control in which a generally upright back support member is pivotally mounted to a support arm extending rearwardly from beneath a seat support member, there being a releasable securing means for securing or alowing adjustment of the angle of the back support member relative to the support arm. The releasable securing means passes through adjacent bottom walls in the back support member and the support arm. The support arm includes an integrally formed safety stop detent flange which prevents the back rest from falling all the way rearwardly in the event that the releasable securing means inadvertently disengages.

9 Claims, 3 Drawing Figures

POSTURE IRON WITH SAFETY STOP

BACKGROUND OF THE INVENTION

The present invention relates to chair controls, particularly posture tilt chair controls which facilitate adjustment of a chair back relative to a chair seat.

In such mechanisms, a support arm extends generally horizontally from beneath the seat support member and a back upright support member is pivotally joined to the generally horizontal support arm. Securing means can be tightened or loosened to facilitate adjusting the angular orientation of the back support member relative to the support arm, thereby facilitating adjustment of the angle of the chair back relative to the chair seat.

Usually, the support arm itself is then pivotally joined to the seat support member and a torsion pack is employed between the two whereby one can lean back against the chair back and the entire back and back supporting mechanism will tilt rearwardly against the action of the torsion member. The torsion system, however, forms no part of the present invention.

The securing means typically comprises a bolt oriented generally horizontally and passing through both the support arm and the upright back support member. A handle on the end of the bolt or on the nut which threads onto the bolt projects laterally to one side or the other of the back upright support member.

This location for the handle is detremental to the appearance of the chair. However, while it would be more desirable to locate the handle underneath the chair in some way, the latter is a more dangerous condition in that if the bolt ever broke or disengaged the handle in some way, it would fall to the floor and the back support member would then be free to fall completely rearwardly. This could result in serious injury to a person seated in the chair at such a time.

Also, locating the handle beneath the mechanism rather than to one side may be considered by some to make it more difficult to adjust the angle of the seat back in that when the securing mechanism is loosened the seat back will tend to flop around and one will have to have one hand on the seat back and another on the handle beneath the seat back.

Heretofore, prior artisans have been unable to conceive of economical arrangements for obviating these shortcomings of prior art posture mechanisms whereby orientation of the handle on the securing means could be located beneath the mechanism rather than to one side thereof.

SUMMARY OF THE INVENTION

In the present invention, the releasable securing means is oriented through the bottom of the chair control, rather than to one side. The back support member and the generally horizontally extending support arm include adjacent bottom walls with adjacent aperatures therein through which the securing means pass. The bottom wall of the support arm includes a detent means which limits the extent to which the back support member can pivot relative to the support arm whereby in the event the releasable securing means inadvertantly disenages, the back support member will not fall all the way to the rear of the chair.

In a narrower aspect of the invention, the back support is prevented from merely flopping about relative to the support arm when the releasable securing means is loosened by providing one of the bottom walls with a laterally extending slot and the other of the bottom walls with a slot extending diagonally relative thereto. This provides sufficient resistance to change of position that one can first adjust the angle of the chair back and then reach beneath the mechanism to tighten the releasable securing means without having to worry about the chair back flopping forwardly or rearwardly in the process.

These and other aspects, features, objects and advantages of the invention will be more fully understood and appreciated by reference to the written specification and appended drawings.

DESCRIPTION OF THE PREFERRED EMBODIMENT

Figure 2:
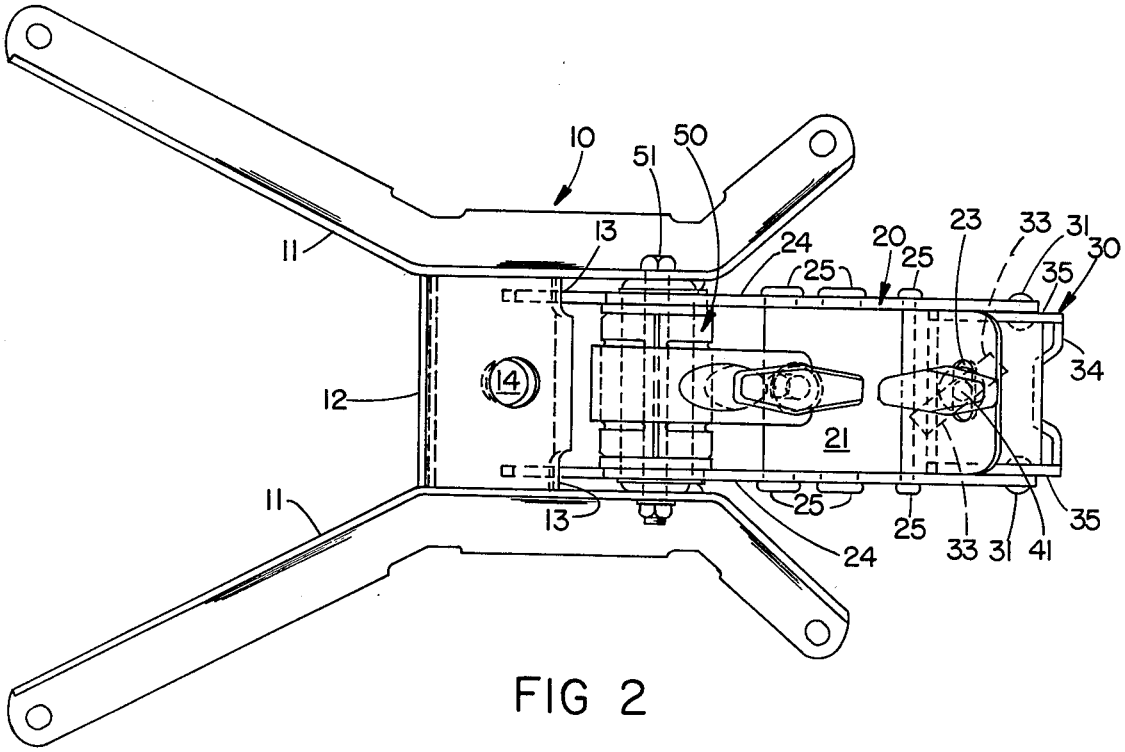
FIG. 2 is a bottom plan view of the control mechanism.
Figure 1:
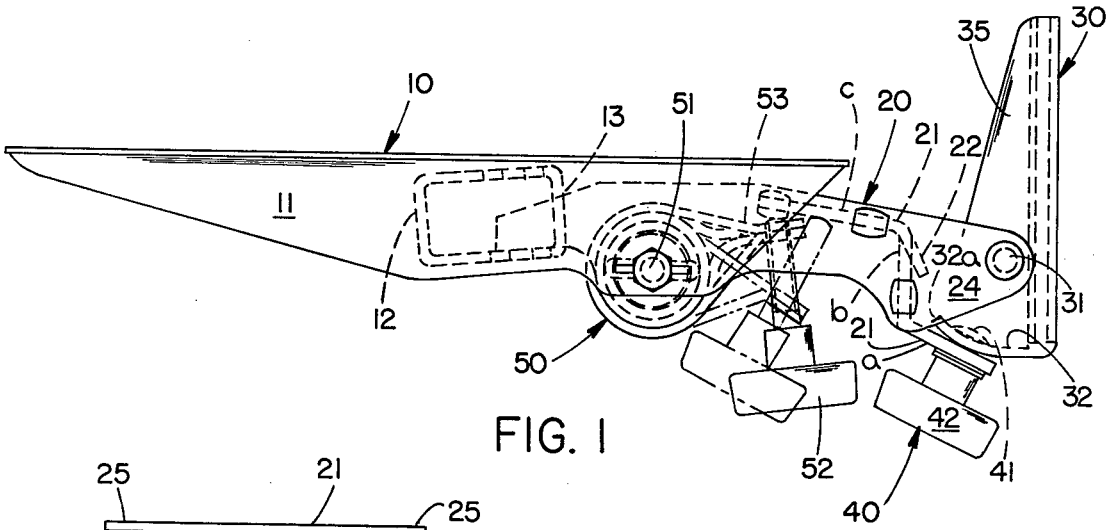
FIG. 1 is a side elevational view of a chair control mechanism embodying the present invention.
Figure 3:
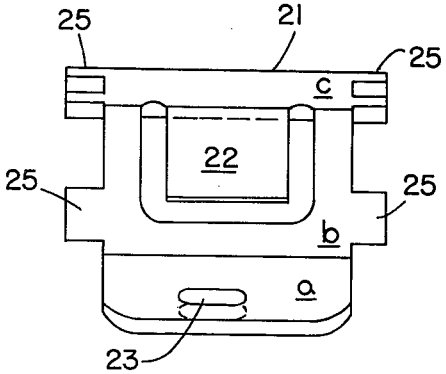
FIG. 3 is a rear elevational view of the bottom wall only of the generally horizontally extending support arm.

In the preferred embodiment, the chair control of the present invention comprises a seat support member 10 for the seat of a chair, a support arm 20 extending rearwardly and generally horizontally therefrom and being pivotally mounted thereon, a back support member 30 pivotally joined to support arm 20, releasable securing means 40 for securing back support 30 against movement relative to support arm 20 and a torsion pack 50 which allows controlled tilting of support arm 20 relative to seat support 10 (FIGS. 1 and 2). The bottom wall 21 of support arm 20 includes an integrally formed detent flange 22 located in the path of the bottom wall 32 of back support 30 so that if releasable securing means 40 breaks and falls to the floor or otherwise disengages, detent 22 will limit the extent of rearward travel of back support 30 and prevent it from falling all the way to the floor or indeed from even approaching a horizontal attitude (FIGS. 1 and 3). A laterally oriented slot 23 in bottom wall 21 of support arm 20 and a diagonally oriented slot 33 in the bottom wall 32 of back support 30 allows for angular adjustment of back support without floppiness when releasable securing means 40 is loosened (FIG. 2).

Seat support 10 is generally conventional, including a pair of spaced stretchers 11 joined by a spindle mount 12 (FIGS. 1 and 2). Stretchers 11 are formed of steel and include apertures in the ends thereof to facilitate bolting to the bottom of a seat in a chair. Spindle mount 12 is a box-like member also formed of steel and includes a hole 14 through the center thereof into which a chair spindle can be mounted. There are slots 13 in the back wall of spindle mount 12 through which the ends of support arm 20 extend so that the extent of travel of support arm 20 relative to seat support 10 is limited by the top and bottom walls of spindle mount 12.

Support arm 20 is formed of steel and is pivotally joined to seat support 10 by a bolt 51 passing through apertures in the spaced side walls 24 of support arm 20 and through the center of a torsion pack 50. The spaced side walls 24 of support arm 20 are joined together by a bottom wall 21. Bottom wall 21 of support arm 20 includes a plurality of flanges 25 (FIG. 3) which project through slots in side wall 24 and which are then welded along to positively secure the metal bottom wall 21 to the metal side walls 24 of support arm 20.

Bottom wall 21 includes a first portion "a" at the rear thereof and which includes an elongated aperture or slot 23 therein which extends laterally relative to the fore and aft access of the chair control (FIGS. 1 and 3). First portion "a" is inclined slightly such that its bottom surface faces slightly forwardly. The purpose of this is to cause the handle or hand wheel 42 on securing means 41 to face forwardly slightly so that it is not as readily visible when the mechanism and the chair on which it is mounted are viewed from the rear.

Projecting almost vertically upwardly from first portion "a" is a second bottom wall portion "b". A detent 22 is created by a slightly rearwardly projecting and downwardly pointing flange 22, which is integrally formed out of wall portion "b" of bottom wall 21 (FIGS. 1 and 3). Flange 22 then points towards the leading edge of the bottom wall 32 of back rest bracket 30.

Bottom wall 21 then includes a third portion "c" which extends forwardly from the generally vertically portion "b" and serves to provide further strength and rigidity to support arm 20.

Back support 30 is also formed of steel and comprises spaced side walls 35 joined by bake wall 34 and a radiused bottom wall 32 (FIGS. 1 and 2). Back support 30 is pivotally joined to support arm 20 by pivot mounting means 31 such as rivets or nut and bolt combinations which pass through round holes both in the side walls 24 of support 20 and in the side walls 35 of back support 30. Back support 30 does not directly support a chair back, but rather supports another upright member which extends downwardly from the chair back and is secured to the back wall 34 of back support 30.

Bottom wall 32 of back support 30 is radiused relative to the axis of pivot mounts 31 and lies in a convex manner against bottom wall 21 of support arm 20. This allows one to pivot back support 30 relative to support arm 20 when releasable securing means 40 is loosened.

Adjustment is further facilitated by the fact that bottom wall 32 includes a diagonal slot 33 therein (FIG. 2) which extends diagonally relative to lateral slot 23 in bottom wall 21 of support arm 20. As a result of the relationship between diagonal slot 33 and lateral slot 23, one can loosen releasable securing means 40 and the chair back will not immediately fall down forwardly or rearwardly. Rather, it will tend to hold its position. Similarly, one can adjust the position of the chair back, let go of it and it will tend to stay put. This enables one to more conveniently reach under the mechanism and tighten releasable securing means 40 up again. This is in contrast to the situation which would exist if diagonal slot 33 were oriented longitudinally, that is to say parallel to the fore and aft axis of the mechanism.

Releasable securing means 40 comprises a threaded bolt 41 which passes through lateral slot 23 and diagonal slot 33, combined with a handle 42 which is threaded onto bolt 41. Due to the inclination of the first portion "a" of bottom wall 21, hand wheel 40 projects slightly forwardly beneath the mechanism.

Torsion pack 50 is conventional and includes an outwardly projecting arm 53 through which is threaded an adjustment bolt 52. The end of adjustment bolt 52 bears against a bottom surface of the front portion "c" of bottom wall 21 of support arm 20. By turning bolt 52, one adjusts pretension in the torsion pack 50. When one leans back in the chair to which the posture control of the present invention is mounted, support arm 20 tilts downwardly against the tension of torsion pack 50.

In operation, one can readily adjust the angle of the chair back relative to the seat by loosening the releasable securing means 40 and tilting the chair back, and therefore back support 30, relative to support arm 20. In the event that the shank of bolt 41 breaks and a portion of the bolt and hand wheel 40 fall to the ground, the chair back will not fall completely rearwardly. Rather, it will fall only until the leading edge 32*a* of bottom wall 32 of back support 30 comes to rest against the leading edge of the detent safety stop flange 22. Because of the orientation of detent 22, the force exerted by a person leaning back in the chair under such accident conditions will be exerted generally through the length of the detent flange, rather than laterally thereof which would tend to bend the flange. Thus, due to this orientation, it is not likely that detent flange 22 would bend or buckle under emergency conditions.

Of course, it is understood that the above is merely a preferred embodiment of the invention and that various changes and alterations can be made of the preferred embodiment without departing from the spirit and broader aspects of the invention.

The embodiments of the invention in which an exclusive property or privilege is claimed are defined as follows.

1. In a chair control having a seat support member and a back support member angularly adjustable relative to said seat support member, the improvement comprising: a support arm extending rearwardly from said seat support member and including a bottom wall with an aperture therein; said back support member being pivotally joined to said support arm and extending generally upwardly therefrom, said back support member including a bottom wall lying adjacent said bottom wall of said support arm at least adjacent said aperture in said support arm, and said bottom wall of said back upright member including an aperture adjacent said aperture of said support arm; releasable securing means passing through said apertures, with at least one of said apertures being larger in at least one dimension than that portion of said releasable securing means which passes through it and with at least said bottom wall of said back support member being radiused relative to the axis of its pivotal connection and in a fore and aft direction and lying against said bottom wall of said support arm in a convex manner whereby said back support member can be angularly adjusted relative to said support arm when said releasable securing means is loosened; a detent positioned on said support arm in the path of movement of said back support relative to said support arm, said detent being located so as to limit the extent to which said back support member can be tipped rearwardly relative to said support arm to thereby prevent said back support member from falling completely rearwardly in the event that said releasable securing means becomes disengaged from said apertures.

2. The chair control of claim 1 in which said releasable securing means includes a handle projecting below said bottom wall of said support arm so as to be accessible to the user, said releasable securing means being loosenable or tightenable by rotation of said handle in the appropriate direction; said bottom wall on said support arm including at least a first portion inclined slightly relative to the horizontal with its bottom surface facing forward slightly, said aperture being located in said first portion, whereby said handle on said releasable securing means projects slightly forwardly and is thereby less visible to one viewing a chair on which said chair control is mounted, from the rear of the chair.

3. The chair control of claim 2 in which said detent comprises a flange integrally formed in the bottom wall of said support arm and projecting therefrom.

4. The chair control of claim 3 in which said bottom wall of said support arm includes a second portion extending generally vertically from said first portion, said detent flange being formed out of said second portion of said bottom wall and pointing outwardly and downwardly from said second portion; the leading edge of said detent flange lying in the path followed by the leading edge of said bottom wall of said back support member as it moves pivotally relative to said support arm.

5. The chair control of claim 4 in which one of said apertures is a slot extending generally laterally of the foreaft axis of said chair control and the other of said apertures is an elongated slot extending generally diagonally relative to said lateral slot whereby said back support does not flop about readily when said releasable securing means is loosened.

6. The chair control of claim 3 in which one of said apertures is a slot extending generally laterally of the foreaft axis of said chair control and the other of said apertures is an elongated slot extending generally diagonally relative to said lateral slot whereby said back support does not flop about readily when said releasable securing means is loosened.

7. The chair control of claim 2 in which one of said apertures is a slot extending generally laterally of the foreaft axis of said chair control and the other of said apertures is an elongated slot extending generally diagonally relative to said lateral slot whereby said back support does not flop about readily when said releasable securing means is loosened.

8. The chair control of claim 1 in which one of said apertures is a slot extending generally laterally of the foreaft axis of said chair control and the other of said apertures is an elongated slot extending generally diagonally relative to said lateral slot whereby said back support does not flop about readily when said releasable securing means is loosened.

9. The chair control of claim 1 in which said detent comprises a flange integrally formed in the bottom wall of said support arm and projecting therefrom.

* * * * *